US006422847B1

(12) United States Patent
Bush et al.

(10) Patent No.: US 6,422,847 B1
(45) Date of Patent: Jul. 23, 2002

(54) SCREW ROTOR TIP WITH A REVERSE CURVE

(75) Inventors: James William Bush, Skaneateles, NY (US); Keshava Basavapatna Kumar, South Windsor, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/876,512

(22) Filed: Jun. 7, 2001

(51) Int. Cl.[7] ..... F03C 2/00
(52) U.S. Cl. ..... 418/201.3
(58) Field of Search ..... 418/201.3

(56) References Cited

U.S. PATENT DOCUMENTS

| | | | | | |
|---|---|---|---|---|---|
| 3,289,600 | A | * | 12/1966 | Whitfield | 418/201.1 |
| 3,423,017 | A | * | 1/1969 | Schibbye | 418/201.3 |
| 4,412,796 | A | * | 11/1983 | Bowman | 418/201.3 |
| 4,435,139 | A | * | 3/1984 | Astberg | 418/201.3 |
| 4,508,496 | A | * | 4/1985 | Bowman | 418/201.3 |
| 4,576,558 | A | * | 3/1986 | Tanaka et al. | 418/201.3 |
| RE32,568 | E | * | 12/1987 | Astberg | 418/201.3 |
| 4,938,672 | A | | 7/1990 | Ingalls | |
| 5,044,906 | A | * | 9/1991 | Tsuboi | 418/201.3 |
| 5,624,250 | A | * | 4/1997 | Son | 418/201.3 |
| 6,139,299 | A | | 10/2000 | Kumar et al. | |

FOREIGN PATENT DOCUMENTS

| | | | | |
|---|---|---|---|---|
| GB | 2092676 | * | 8/1882 | 418/201.3 |
| JP | 11-141479 | * | 5/1999 | 418/201.3 |

* cited by examiner

*Primary Examiner*—Thomas Denion
*Assistant Examiner*—Theresa Trieu
(74) *Attorney, Agent, or Firm*—Bachman & LaPointe, P.C.

(57) ABSTRACT

A rotor for a screw rotor machine includes a shaft and a plurality of lobes disposed on the shaft, each of the lobes extending radially outward from the shaft and having a tip surface, a rear surface and a transition section disposed between the tip surface and the rear surface, the transition section having an arcuate portion, a middle portion and a short radius portion, the arcuate portion being concave in shape so as to open away from the shaft and transition the tip surface into the middle portion.

5 Claims, 2 Drawing Sheets

SCREW ROTOR TIP WITH A REVERSE CURVE

BACKGROUND OF THE INVENTION

The present invention relates to a screw rotor tip design wherein the screw rotor tip has a geometry that allows the departure angle, pressure angle and lobe width to be selected or controlled independently of each other, thereby allowing greater flexibility in rotor design.

Screw compressors contain a variety of components that may directly affect the performance of the compressor. One of these components is the screw rotor tip. There are at least three parameters of the screw rotor tip that may add or detract from the performance or efficiency of the compressor. These parameters are the pressure angle, the lobe width and the departure angle. Although these parameters have various ranges in which their contribution to the compressor performance is minimized or maximized, certain elements of these parameters are constant.

FIG. 1 illustrates a conventional screw rotor tip having a tip portion 1, a short radius portion 2 and a transition 3 positioned therebetween.

The departure angle is shown at angle A and is defined as the angle between a line drawn tangent to tip 1 and a line drawn tangent through the surface of transition section 3 substantially adjacent to tip 1. As should be readily apparent, with this type of conventional tip structure, the departure angle A can be increased only by increasing the slope of transition section 3 which undesirably cuts down on the lobe width thickness 4 and which itself is undesirable, and which can also dictate a smaller radius for short radius portion 2 than is desired. Thus, in situations where a large departure angle A is desired, other features of the conventional lobe tip are adversely impacted.

Therefore, a need remains for a screw rotor tip design that allows the pressure angle, lobe width and departure angle to be determined and controlled independently of each other.

It is therefore the object of the present invention to provide a screw rotor tip design that has a departure angle, a pressure angle and a lobe width that can be determined and controlled independently.

Other objects and advantages will appear hereinbelow.

SUMMARY OF THE INVENTION

In accordance with the present invention, the foregoing objects and advantages are readily attained.

According to the invention, a rotor for a screw rotor machine includes a shaft, and a plurality of lobes disposed on the shaft, each of the lobes extending radially outward from the shaft and having a tip surface, a rear surface and a transition section disposed between the tip surface and the rear surface, the transition section having an arcuate portion, a middle portion and a short radius portion, the arcuate portion being concave in shape so as to open away from the shaft and transition the tip surface into the middle portion.

BRIEF DESCRIPTION OF THE DRAWINGS

A detailed description of preferred embodiments of the present invention follows, with reference to the attached drawings, wherein.

DETAILED DESCRIPTION

The invention relates to a rotor design for screw rotor machines and, more particularly, to the structure of a screw rotor tip.

Figure 1:
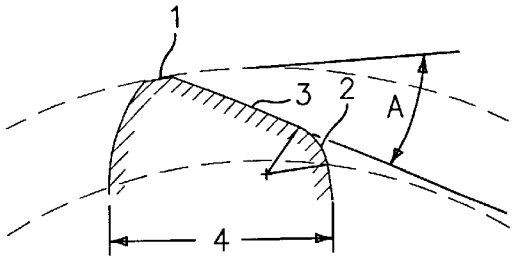
FIG. 1 (PRIOR ART)
FIG. 1 is a side sectional view of a prior art rotor tip.
Figure 2:
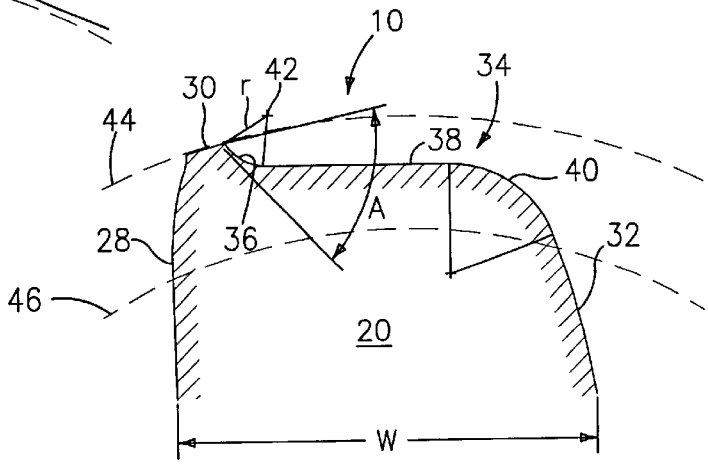
FIG. 2 is a side sectional view of a female rotor tip in accordance with the present invention.
Figure 3:
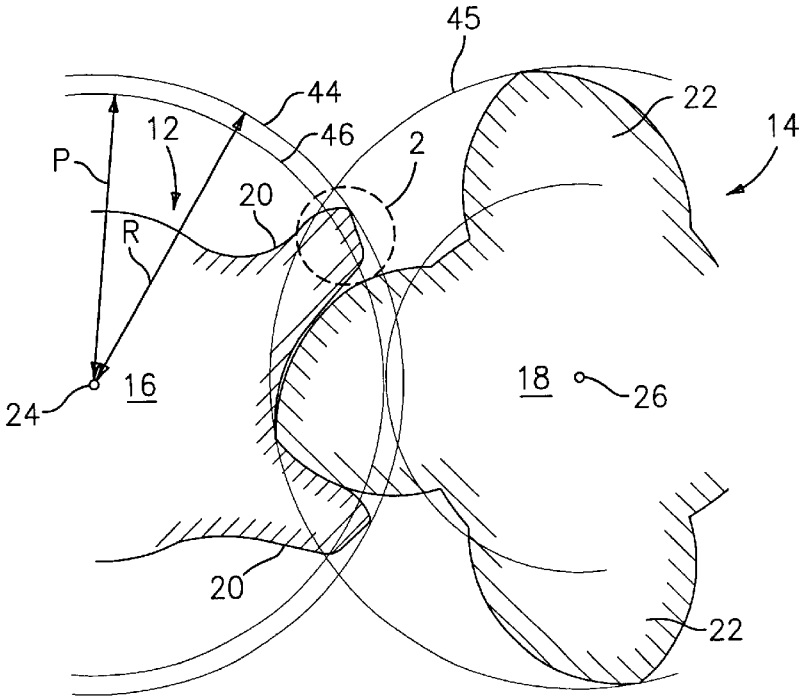
FIG. 3 is a side sectional view of a female screw rotor and a male screw rotor further illustrating an environment of use of the present invention.

FIG. 2 illustrates a rotor tip 10 in accordance with the present invention, and FIG. 3 illustrates an environment of use for same.

As shown in FIG. 3, a screw rotor machine typically involves a plurality of rotors which interact so as to compress fluid forced or drawn between the rotors. FIG. 3 shows a female rotor 12 and a male rotor 14, each of which has a shaft portion 16, 18 and a plurality of lobes 20, 22 extending radially outwardly from the shaft, typically in a substantially helical configuration such that lobes of cooperating rotors interact with each other so as to provide the desired fluid compression as is well known to a person of ordinary skill in this art.

Rotors 12, 14 are typically disposed in a rotor housing and mounted such that they are rotatable about substantially fixed axes 24, 26. The present invention relates to an improved structure or geometry for the tip 10 of the rotor lobe. FIG. 2 shows a tip 10 which is well suited for use with female rotor 12, and which corresponds to the circled portion of FIG. 3. As will be discussed below, this structure can advantageously be incorporated into lobes 22 of male rotor 14, as well.

Turning now to FIG. 2, tip 10 in accordance with the present invention is advantageously provided having a front or lead surface 28, a tip surface 30, a rear or trailing surface 32, and a transition section 34 disposed between tip surface 30 and rear surface 32.

In accordance with the present invention, transition section 34 is advantageously provided having an arcuate portion 36, a middle portion 38 and a short radius section 40.

Arcuate portion 36 is advantageously an outwardly concave, or "reverse curve" surface which is positioned substantially adjacent to tip surface 30 so as to advantageously allow for a desirably large departure angle A while nevertheless maintaining a desirably large lobe width W.

This is particularly desirable as a large lobe width provides a large, strong rotor structure which is less susceptible to deflection and its associated inaccuracies during the machining processes used during manufacture. This also provides a large spacing between male rotor lobes which allows use of a large, strong cutting tool, which in turn reduces cutting tool deflections and resulting inaccuracies. A large departure angle helps to reduce the buildup of an oil film along the tip circle between tip surface 30 and the inner surface of the housing and thereby helps to reduce the amount of viscous drag on the rotor. Thus, the tip structure of the present invention advantageously allows for design of rotors that are both efficient, structurally strong, and easy to manufacture.

Still referring to FIG. 2, arcuate portion 36 is advantageously illustrated as a concave surface opening outwardly (as measured relatively to the radius of the lobe), and is advantageously a curved surface formed about a center point 42 which is spaced radially outwardly from arcuate portion 36, also taken with respect to the radius of the lobe. Arcuate portion 36 may be a simple curved surface formed about a single center point, or may be a complex curved surface if desired. The particular advantage of arcuate portion 36, however, is that the segment of arcuate portion 36 that is closest to tip surface 30 departs away from the inner surface of the housing, or the tip circle 44, at a large angle, while curving back to a middle portion 38 that is at a substantially smaller angle relative to tip circle 44 and which therefore allows for a lobe width W which is as wide as may be desired.

This structure, and a middle portion 38 which is at a relatively small angle with a line drawn tangent to tip circle 44 and tip surface 30, also advantageously allows for provision of a short radius portion 40 that is larger than could be accomplished without using arcuate portion 36. As set forth above, it is desirable to have a relatively large short radius portion such that a larger tool can be used in machining, thereby providing better control during same.

In further accordance with the present invention, it has been found advantageous to provide arcuate portion 36 having a radius "r" which is at least about 1 mm, and can be as large as about one half of the difference between the radius R of tip circle 44 and the radius P of a pitch circle 46 of the rotor. Thus, reverse radius r is advantageously between about 1 mm and about ½ (R-P).

Figure 2A:
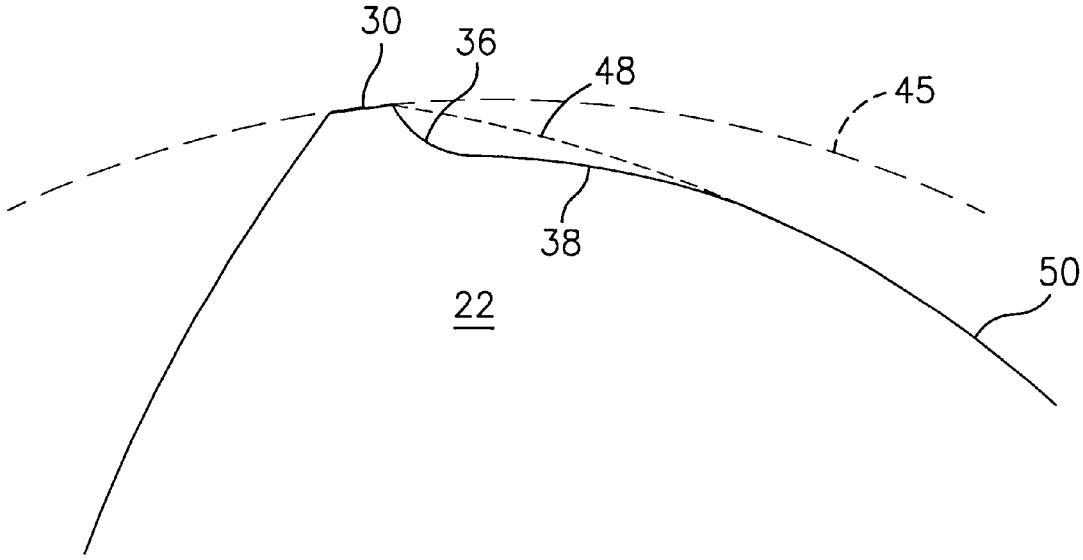
FIG. 2*a* is a side sectional view of a male rotor tip in accordance with the present invention.

It should readily be appreciated that the tip structure in accordance with the present invention as illustrated in FIG. 2 could also be incorporated into the tip of a lobe 22 of a male rotor 14, as well, and such a structure is illustrated in FIG. 2*a* showing lobe 22 defining a tip circle 45 and having reverse radius 36 in accordance with the present invention.

FIG. 2*a* also shows a conventional tip structure 48 in dashed lines, and shows middle portion 38 having a curve in this embodiment. In accordance with the invention, middle portion 38 and the remainder 50 of the curved tip surface can advantageously be provided as a single curve. Of course, this portion could be a complex curve if desired, but a single curve simplifies machining as desired in accordance with the invention.

As set forth above, the lobe tip structure of the present invention advantageously provides a designer with the ability to independently select and design the pressure angle, lobe width and departure angle parameters of a rotor.

A further advantage of the present invention is that it allows the short radius portion 40 to be positioned well above pitch circle 46, which is desirable, and which also helps to keep the radius of the short radius portion 40 large.

In accordance with the present invention, the shaft and the screw rotor tip may be constructed of any material suitable to the desired end product.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A rotor for a screw rotor machine, comprising:

a shaft; and a plurality of lobes disposed on said shaft, each of said lobes extending radially outward from said shaft and having a tip surface, a rear surface and a transition section disposed between said tip surface and said rear surface, said transition section having an arcuate portion, a middle portion and a short radius portion, said arcuate portion being concave in shape so as to open away from said shaft and transition said tip surface into said middle portion.

2. The screw rotor according to claim 1, wherein said short radius portion is convex in shape so as to transition said middle portion into said rear surface.

3. The screw rotor according to claim 1, wherein said middle portion is substantially straight.

4. The screw rotor according to claim 1, wherein said arcuate portion is defined around a center point spaced radially outwardly with respect to said shaft from said arcuate portion.

5. The screw rotor according to claim 1, wherein each lobe of said lobes has a lobe radius R and a pitch radius P, and wherein said arcuate portion has a reverse radius r which is between about 1 mm and about ½ (R-P).

* * * * *